US008876230B2

(12) United States Patent
Lowe et al.

(10) Patent No.: US 8,876,230 B2
(45) Date of Patent: Nov. 4, 2014

(54) DURABLE DRAWER RETAINER APPARATUS AND METHOD OF USE

(75) Inventors: Mark Jeffrey Lowe, Bossier City, LA (US); Grant Nuckolls, Bossier City, LA (US)

(73) Assignee: Hardware Resources, Inc., Bossier City, LA (US)

( * ) Notice: Subject to any disclaimer, the term of this patent is extended or adjusted under 35 U.S.C. 154(b) by 344 days.

(21) Appl. No.: 13/200,571

(22) Filed: Sep. 24, 2011

(65) Prior Publication Data

US 2013/0077900 A1 Mar. 28, 2013

(51) Int. Cl.

| | |
|---|---|
| ***A47B 95/00*** | (2006.01) |
| ***A47B 88/10*** | (2006.01) |
| *A47B 88/04* | (2006.01) |

(52) U.S. Cl.

CPC ..... *A47B 88/10* (2013.01); *A47B 2210/0081* (2013.01); *A47B 2210/0018* (2013.01); *A47B 2088/0474* (2013.01)

USPC ..... 312/333; 312/319.1

(58) Field of Classification Search

USPC ..... 312/330.1, 333, 334.1, 334.7, 334.8, 312/334.44, 319.1; 384/21

See application file for complete search history.

(56) References Cited

U.S. PATENT DOCUMENTS

| | | | | |
|---|---|---|---|---|
| 2,731,321 | A * | 1/1956 | Thompson | 312/334.46 |
| 3,203,749 | A | 8/1965 | Bullock et al. | |
| 3,335,453 | A * | 8/1967 | Lovelace | 16/82 |
| 3,371,968 | A | 3/1968 | Loake | |
| 3,801,166 | A | 4/1974 | York | |
| 4,139,249 | A * | 2/1979 | Hillman | 312/333 |
| 4,370,007 | A | 1/1983 | Fler | |
| 4,469,384 | A | 9/1984 | Fler et al. | |
| 4,696,582 | A | 9/1987 | Kasten | |
| 4,988,214 | A | 1/1991 | Clement | |
| 5,344,226 | A * | 9/1994 | Lee | 312/334.47 |
| 5,405,195 | A * | 4/1995 | Hobbs | 312/334.46 |
| 5,484,197 | A | 1/1996 | Hansen et al. | |
| 5,507,571 | A * | 4/1996 | Hoffman | 312/334.8 |
| 5,634,703 | A | 6/1997 | Vonier | |
| 5,757,109 | A | 5/1998 | Parvin | |
| 5,775,788 | A | 7/1998 | Sasse et al. | |
| 6,102,452 | A * | 8/2000 | Liau | 292/175 |

(Continued)

FOREIGN PATENT DOCUMENTS

| | | |
|---|---|---|
| CN | 2569641 | 9/2003 |
| CN | 2764235 | 3/2006 |
| EP | 0743032 | 11/1996 |
| GB | 2434306 | 7/2007 |

*Primary Examiner* — Darnell Jayne
*Assistant Examiner* — Ryan A Doyle
(74) *Attorney, Agent, or Firm* — Schultz & Associates, P.C.

(57) ABSTRACT

A full extension ball bearing drawer slide assembly comprised of a fixed member attached to a cabinet piece, a middle member slidingly engaged with the fixed member with a set of linear bearings, a drawer member attached to a drawer piece slidingly engaged with the middle member via a second set of linear bearings, and a drawer retainer mechanism attached to the drawer member and in adjustable contact with the drawer member. The drawer retainer mechanism is comprised of a frame attached to the drawer member, a housing seated in the frame, a piston fitted in the frame and biased by a helical spring adjacent a post. The post has a threaded section engaged with a threaded hole in the frame. The piston, biased by the helical spring on the post, is forced towards the housing by a raised indention in a race of the fixed member.

6 Claims, 6 Drawing Sheets

(56) References Cited

U.S. PATENT DOCUMENTS

| | | | | |
|---|---|---|---|---|
| 6,155,661 | A * | 12/2000 | O'Neil et al. | 312/334.44 |
| 6,238,031 | B1 | 5/2001 | Weng et al. | |
| 6,244,678 | B1 | 6/2001 | Dopp et al. | |
| 6,254,205 | B1 | 7/2001 | Wright et al. | |
| 6,350,001 | B1 * | 2/2002 | Chu | 312/334.44 |
| 6,435,636 | B1 | 8/2002 | MacMillan | |
| 6,450,600 | B1 | 9/2002 | Chen et al. | |
| 6,497,464 | B1 | 12/2002 | Cammack et al. | |
| 6,685,288 | B1 | 2/2004 | MacMillan | |
| 6,899,408 | B2 | 5/2005 | Chen et al. | |
| 6,938,967 | B2 | 9/2005 | Dubon et al. | |
| 7,111,913 | B2 | 9/2006 | Dubon | |
| 7,320,507 | B2 | 1/2008 | White et al. | |
| 7,347,516 | B2 | 3/2008 | Hay | |
| 7,364,245 | B2 | 4/2008 | Dubon | |
| 7,404,611 | B1 | 7/2008 | Que | |
| 7,441,848 | B2 | 10/2008 | Chen et al. | |
| 7,458,651 | B1 * | 12/2008 | Radke et al. | 312/333 |
| 7,520,577 | B2 | 4/2009 | Chen et al. | |
| 7,552,982 | B2 | 6/2009 | Beaudoin | |
| 7,802,856 | B2 | 9/2010 | Hashemi et al. | |
| 7,857,403 | B2 | 12/2010 | Chen et al. | |
| 2003/0122460 | A1 | 7/2003 | Chang | |
| 2003/0184197 | A1 * | 10/2003 | Lai | 312/333 |
| 2005/0248247 | A1 | 11/2005 | Huang | |
| 2005/0269922 | A1 * | 12/2005 | Lai | 312/334.46 |
| 2006/0082267 | A1 * | 4/2006 | Lin | 312/333 |
| 2006/0103279 | A1 * | 5/2006 | Lai | 312/333 |
| 2006/0152119 | A1 * | 7/2006 | Park | 312/404 |
| 2007/0278920 | A1 * | 12/2007 | Chen | 312/334.44 |
| 2008/0226208 | A1 * | 9/2008 | Duan et al. | 384/35 |
| 2008/0265729 | A1 * | 10/2008 | Netzer et al. | 312/330.1 |
| 2008/0303397 | A1 * | 12/2008 | Chen et al. | 312/334.46 |
| 2012/0169199 | A1 * | 7/2012 | Chen et al. | 312/334.44 |
| 2012/0187816 | A1 * | 7/2012 | Chen et al. | 312/334.8 |

* cited by examiner

DURABLE DRAWER RETAINER APPARATUS AND METHOD OF USE

FIELD OF THE INVENTION

The present invention relates to sliding assemblies for mounting drawers in cabinetry. In particular, the invention relates to extension ball bearing slides with a durable, front mounted, adjustable drawer retainer mechanism which prohibits the inadvertent opening of a closed drawer.

BACKGROUND OF THE INVENTION

Drawer slides mounted to cabinets and drawers for slidably moving a drawer in a cabinet are well known in the art. Drawer slides are typically constructed of two or more rails which are telescopically extendable. In standard practice, the outer most rail is the widest and is mounted to the stationary cabinet wall and encloses the inner rails. The innermost rail is typically mounted on the side or underneath the drawer piece. The rails usually incorporate ball bearings mounted in retainers and seated in races formed in the sides of the rails so that the rails may slide with respect to each other. This low friction provided by the rails allows the drawer to move between the open and closed positions with minimal effort. As a result, drawers are often closed rapidly and with excess force and have a tendency to rebound when closed. In cabinetry installed in mobile homes, recreational vehicles, or boats, the low friction provided by the rails allows unintentionally opening drawers during vehicle movement.

U.S. Pat. No. 5,757,109 to Parvin discloses a telescopic drawer slide with a soft sequencing latch. The soft sequencing latch comprises a latch arm carried by a slide member. A spring arm extending from the latch arm in compressive contact with the slide member biasing the latch arm into engagement with a locking element on a second slide member and an actuator on a third slide member for disengaging the latch arm. The actuator disengages the latch arm by applying a force to the latch arm with a component oppositely directed and of sufficient magnitude to overcome the compressive spring force. Interaction of the locking element with the latching arm and the interaction of the actuator with the latching arm may both serve as frictional interfaces during slide operation. The device requires a component on each slide member and the latch arm is susceptible due to constant deformation and frictional forces. Further, the force applied by the soft sequencing latch is not adjustable.

U.S. Pat. No. 6,244,678 to Dopp, et al. discloses drawer slide with front-mounted stop/anti-rebound mechanism. Two stop/anti-rebound pieces comprised of resilient arcuate segments are individually attached at the forward ends of a first rail and a second rail of the rail assembly. The stop/anti-rebound mechanism engages when the first and second rails are in a closed position and prevent the first and second rails from moving beyond a closed position. The force applied by the stop/anti-rebound mechanism is not adjustable. The stop/anti-rebound mechanism includes certain arcuate segments that are prone to failure due to repeated deformation.

U.S. Pat. No. 6,435,636 to MacMillan discloses a cushion end stop detent member for a drawer slide having a set of cushioning arms, a detent projection, and a frictional ramp. The cushion and detent projection element is made from a resilient material and is attached to the inside of the outer rail of a three rail drawer assembly. The cushioning arms and the frictional ramp engage and cushion the movement of the middle rail. The detent projection cooperates with a receptor in the inner rail. The device is prone to wear and deteriorates over time due to friction and repeated deformation. The device is not adjustable.

U.S. patent to Radke, et al. discloses a drawer slide assembly having an adjustable integral strike and catch mechanism. An adjustable strike is included on a first slide member. A catch is included on a second slide member. The strike and catch engage when the drawer is closed. A strike fastener allows for adjustment of the strike position. The strike is deformable and so is prone to wear due to frictional forces and repeated deformation.

There is a need for a less expensive, less complicated, and easily installed alternative to prior art drawer slides which secure closure of drawers. The drawer retainer mechanism disclosed provides an inexpensive yet durable, front mounted device for securing a drawer which provides ease of installation and more durable components which increase the user life of the slide and reduce the frequency of required replacement.

SUMMARY OF INVENTION

A preferred embodiment provides an extension ball bearing drawer slide assembly with stay closed mechanism. The preferred embodiment is an inexpensive alternative to prior art drawer slide assemblies which prolongs the usable life of the drawer slide assembly and the cabinet piece by providing a front mounted and adjustable stay closed drawer retainer mechanism.

Accordingly, an embodiment of the apparatus includes a drawer slide assembly comprised of a fixed member, a middle member slidingly engaged with the fixed member via a set of linear bearings, a drawer member slidingly engaged with the middle member via a second set of linear bearings, and a drawer retainer mechanism attached to the drawer member. The fixed member is attached to the cabinet piece, and the drawer member is attached to the drawer piece of furniture. The drawer retainer mechanism is comprised of a frame attached to the drawer member, a housing seated in the frame, a piston fitted in the frame and spaced from one interior surface of the frame by a helical spring. The helical spring is centered on a screw threaded into the frame. The piston, biased by the helical spring, is urged upward by a raised indention in the race of the fixed member as the drawer is opened or closed. Once the piston passes the raised indention, the drawer retainer mechanism retains the drawer in a closed position and hence prevents the drawer member from opening without a sufficient force applied in the opening direction.

An alternate preferred embodiment attaches the housing directly to the drawer member. A hole in the housing is threaded to receive a threaded plug to adjustably bias the piston against the raised indention.

Those skilled in the art will appreciate the above-mentioned features and advantages of the invention together with other important aspects upon reading the detailed description that follows in conjunction with the drawings provided.

BRIEF DESCRIPTION OF THE DRAWINGS

In the detailed description of the preferred embodiments presented below, reference is made to the accompanying drawings.

DETAILED DESCRIPTION OF THE PREFERRED EMBODIMENT

Figure 1:
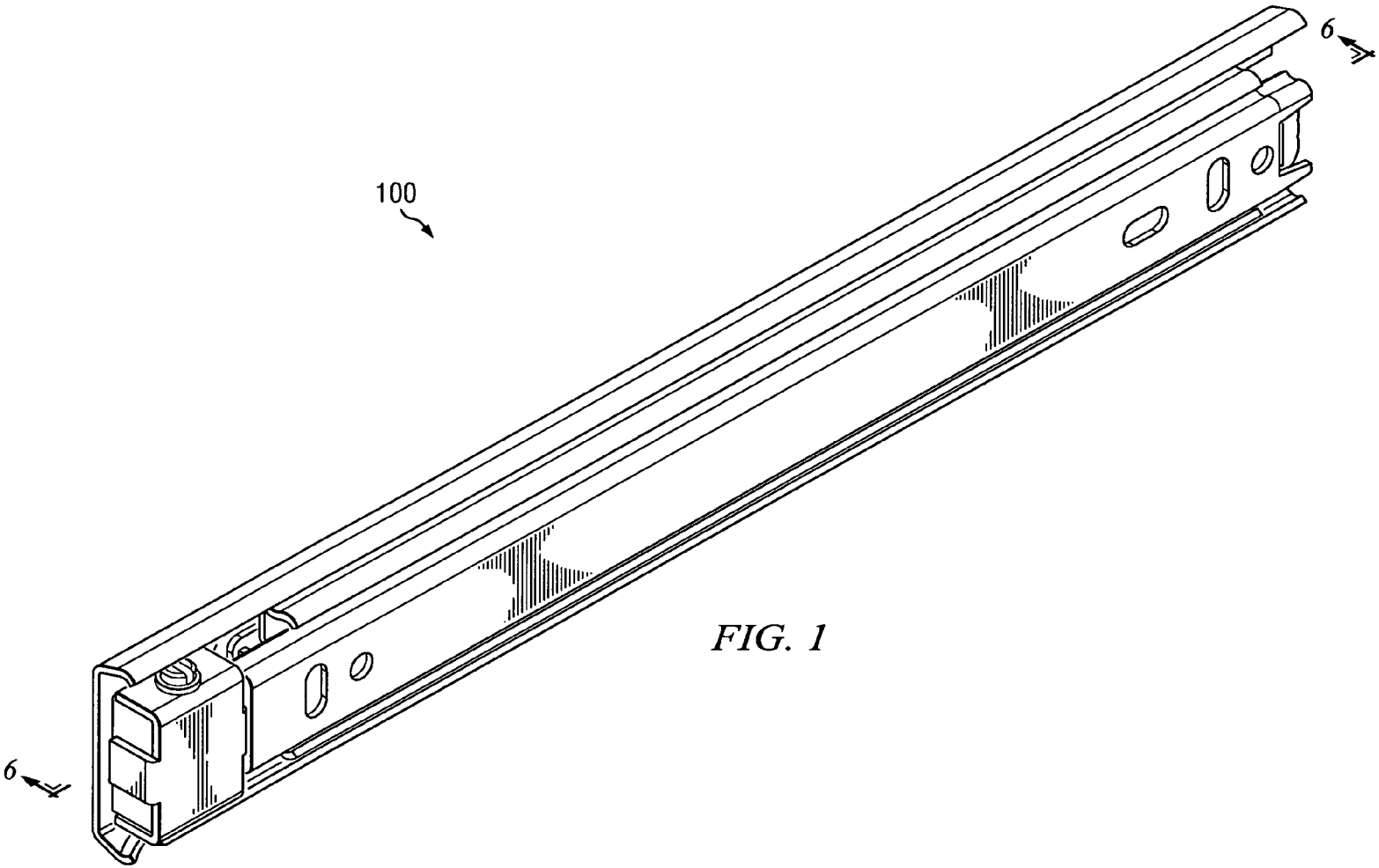
FIG. 1 is an isometric view of a preferred embodiment of a drawer slide assembly.

In the descriptions that follow, like parts are marked throughout the specification and drawings with the same numerals, respectively. The drawing figures are not necessarily drawn to scale and certain figures may be shown in exaggerated or generalized form in the interest of clarity and conciseness.

Figure 2:
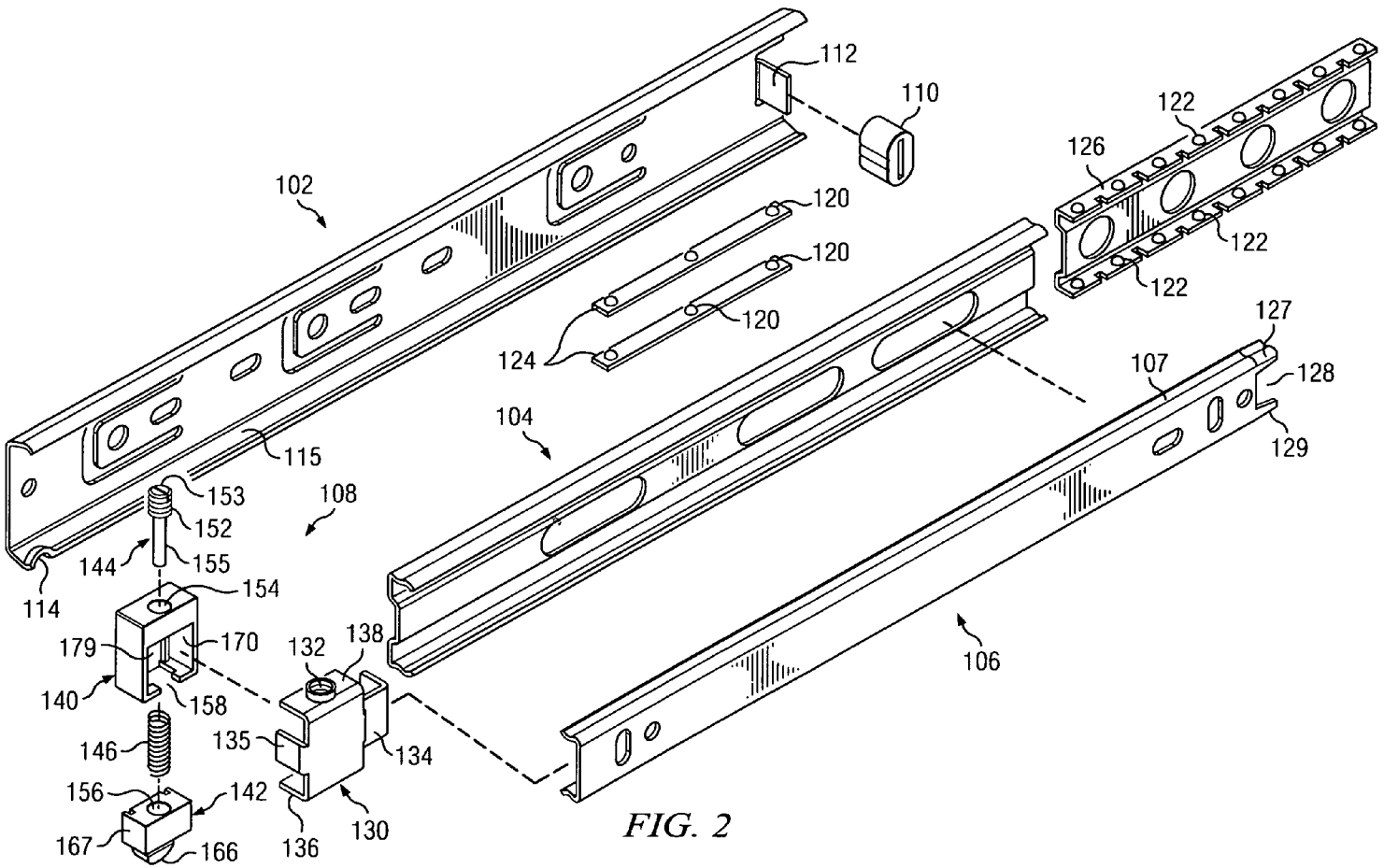
FIG. 2 is an exploded isometric view of a preferred embodiment of a drawer slide assembly.

Referring to FIGS. 1 and 2, drawer slide assembly 100 is comprised of fixed member 102, middle member 104, drawer member 106, and drawer retainer mechanism 108. Each member 102, 104, and 106 of drawer slide assembly 100 is generally C-shaped and includes a pair of races for housing ball-bearing assemblies. Fixed member 102 is mounted to the inside of the cabinet frame of a furniture piece having a drawer using common attachment hardware such as wood screws. Although three slides are shown, it is understood that a greater or lesser number of slides may be telescopically engaged with one another.

Proximate the front end of fixed member 102 is raised indention 114 located in race 115 for engagement with drawer retainer mechanism 108. Proximate the opposite end of fixed member 102 extends tab 112. Bumper 110 is attached to tab 112. In one embodiment, bumper 110 is formed of rubber or similar deformable yet resilient material and is frictionally held in place on tab 112 via a slot which tab 112 extends through. In other embodiments, bumper 110 is formed of nylon or Teflon®.

Middle member 104 is slidingly engaged with fixed member 102 via a series of ball bearings 120 held in bearing retainer 124. Drawer member 106 is slidingly engaged with middle member 104 via a second series of ball bearings 122 held in a second bearing retainer 126. Drawer member 106 is mounted to the side of the drawer frame of the cabinet piece using common attachment hardware such as wood screws through a plurality of mounting holes. From rear end 107 of drawer member 106 extend extensions 127 and 129 which define cavity 128. Extensions 127 and 129 are slightly angled towards one another resulting in the distance between them being smaller than the height of drawer member 106. The distance between extensions 127 and 129 is slightly less the width of bumper 110 so that when engaged, drawer member 106 is frictionally held adjacent bumper 110. In a preferred embodiment, drawer retainer mechanism 108 is attached to the front facing end of drawer member 106 opposite extensions 127 and 129 and cavity 128. As this front mounted feature is preferred for easier maintenance and replacement, it should be understood that the desired effect of preventing the inadvertent opening of the drawer and the rebound of the closed drawer can be accomplished if drawer retainer mechanism 108 were to be mounted on rear end 107 of drawer member 106.

Figure 6:
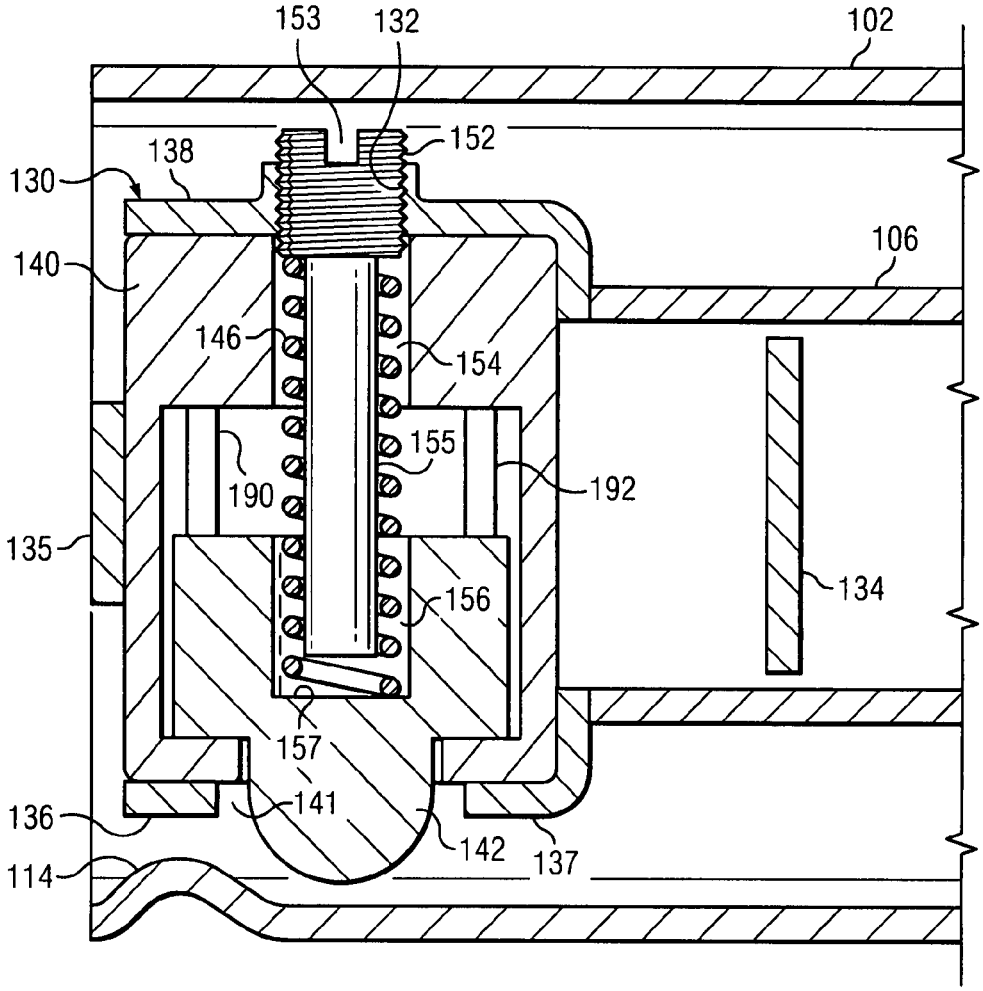
FIG. 6 is a partial cross section view in a closed position of a preferred embodiment of a drawer slide assembly along line 6-6 of FIG. 1.

As seen best in FIGS. 2 and 6, drawer retainer mechanism 108 is comprised of frame 130 mounted to the front facing end of drawer member 106, housing 140 contained in frame 130, and piston 142 seated within housing 140. Frame 130 includes flanges 134, 135, 136, 137, and 138 which form a generally open-sided rectangular box. Flange 134 connects frame 130 to drawer member 106 via a weld or other connection means common in the art. Flange 135 opposes flange 134. Flange 138 includes threaded hole 132. Flange 138 opposes flanges 136 and 137. Flanges 136 and 137 are separated by gap 141.

Figure 3:
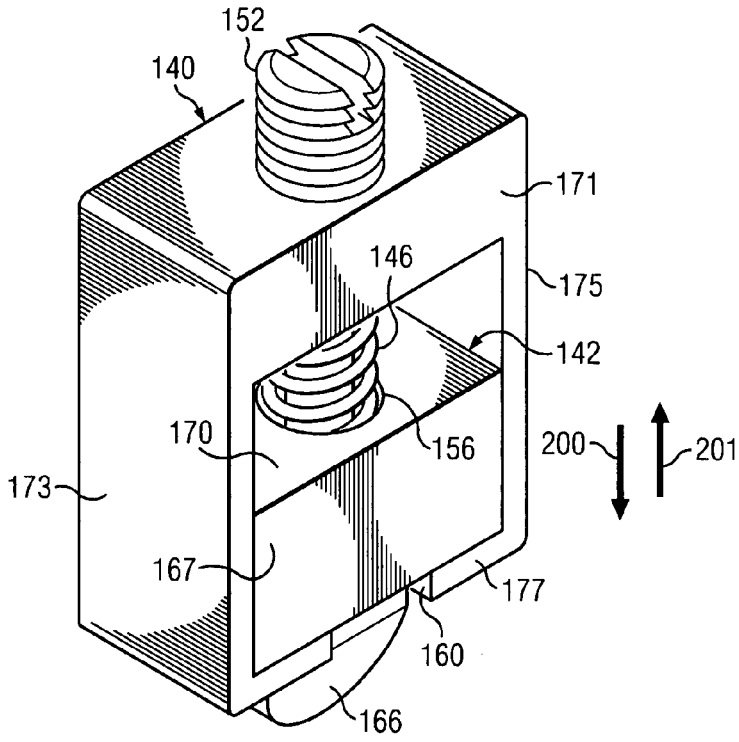
FIG. 3 is an isometric view of a preferred embodiment of the housing and piston of the drawer retainer mechanism.
Figure 4:
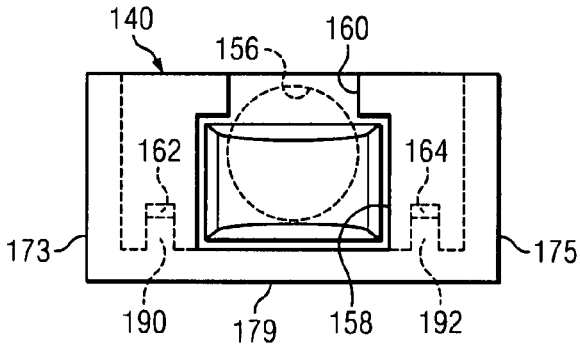
FIG. 4 is a plan view from the underside of a preferred embodiment of the housing and piston of the drawer retainer mechanism.

As seen best in FIGS. 2, 3, and 4, housing 140 is comprised of center support 171, walls 173 and 175, base support 177, and guide wall 179. The center support, walls, base support and guide wall form cavity 170. Hole 154 passes through center support 171 into cavity 170. Slot 158 is provided in base support 177 and is located opposite from and axially aligned with hole 154. Slot 158 includes open end 160. Open end 160 is less in width than slot 158 thereby creating a stepped recess and retaining piston 142 within cavity 170. Guide wall 179 includes guide ridges 190 and 192. Guide ridges 190 and 192 are integrally formed raised ridges generally parallel to each other and parallel to the longitudinal axis of screw 144. Housing 140 is preferably cast from plastic or similar lightweight yet durable material and is generally rectangular in shape.

Figure 5:
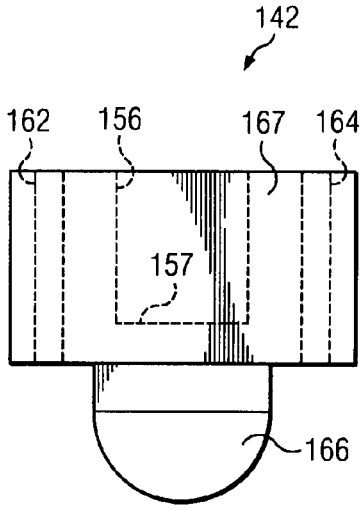
FIG. 5 is an elevation view of a preferred embodiment of the piston.

As shown in FIG. 5, detent 142 comprises a combined rectangular body 167 and rounded protrusion 166. Piston 142 further includes hole 156 having bottom 157. Channels 162 and 164 flank hole 156 and are spaced to slidingly engage guide ridges 190 and 192. In one embodiment, Channels 162 and 164 contain lubrication to ensure unencumbered linear movement of piston 142 with respect to housing 140. The axes of channels 162 and 164 are generally parallel with the axis of hole 156. Piston 142 is preferably cast from plastic or similar lightweight yet durable material. In alternate embodiments, piston 142 is constructed of Delrin, nylon or Teflon®.

Screw 144 includes threaded section 152, spanner head 153, and shaft 155. Spanner head 153 is shaped to accept a torsional force from a spanner. Screw 144 attaches housing 140 to frame 130 as threaded section 152 engages threaded hole 132. Screw 144 does not contact and is not connected to piston 142. When assembled, screw 144, threaded hole 132, hole 154, and hole 156 are axially aligned. Spring 146 surrounds shaft 155 and is simultaneously constrained by shaft 155, hole 154 and hole 156. In an alternate embodiment, shaft 155 is not necessary as spring 146 is constrained by holes 154 and 156. Spring 146 passes through hole 154 and is seated in hole 156. Spring 146 provides a bias between frame 130 and bottom 157 thus forcing piston 142 out of housing 140 and extending protrusion 166 through slot 158 and through gap 141.

Figure 7A:
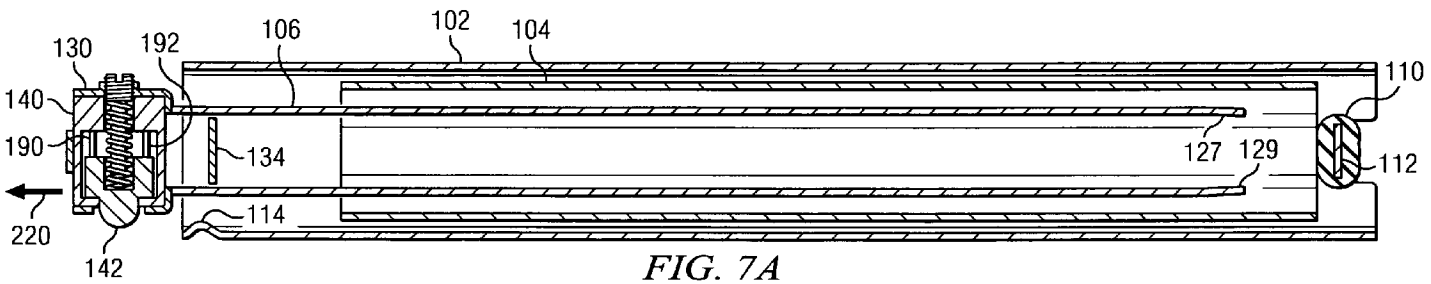
FIG. 7A is a cross section view of a preferred embodiment of a drawer slide assembly in an opened position.
Figure 7B:
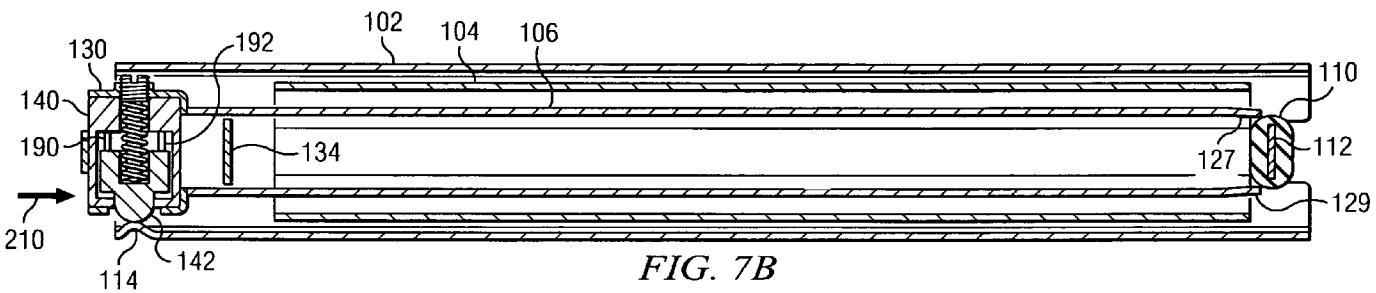
FIG. 7B is a cross section view of a preferred embodiment of a drawer slide assembly between an opened and closed position.
Figure 7C:
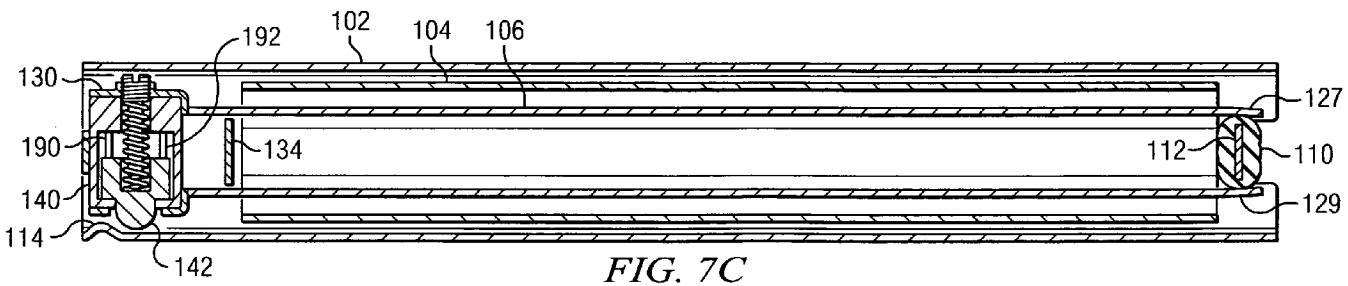
FIG. 7C is a cross section view of a preferred embodiment of a drawer slide assembly in a closed position.

As shown in FIGS. 7A, 7B and 7C, in use, a pair of drawer slide assemblies 100 are typically mounted one on each side of a drawer and to opposing inside surfaces of a cabinet piece.

In an "opened" position as shown in FIG. 7A, the front end of drawer member 106 is extended beyond the front end of fixed member 102. Drawer retainer mechanism 108 is not engaged with raised indention 114 and bumper 110 is not wedged between extensions 127 and 129. As a result the drawer is free to slide in direction 220 to a fully open position.

Referring to FIG. 7B, during a closing sequence, a force applied in the closing direction shown by arrow 210 causes drawer member 106 and drawer retainer mechanism 108 to approach fixed member 102. Because spring 146 is compressed between threaded section 152 and piston 142, the bias of spring 146 tends to force piston 142 out of housing 140 thus extending protrusion 166 through slot 158 and between flanges 136 and 137 through gap 141. Piston 142 is held within housing 140 by the result of the width of body 167 being wider than slot 158. Once protrusion 166 contacts raised indention 114, raised indention 114 forces protrusion 166, against the bias of spring 146, to move in a direction parallel to the longitudinal axis of screw 144 through gap 141 and slot 158 until protrusion 166 has retreated towards housing 140 enough to successfully bypass raised indention 114. Guide ridges 190 and 192 engaged with channels 162 and 164 in cooperation with walls 173 and 175 prevent piston 142 from rotating or jamming within housing 140 during engagement with raised indention 114. Simultaneously, as protrusion 166 clears raised indention 114, extensions 127 and 129 engage bumper 110. After passing raised indention 114, spring 146 forces protrusion 166 through slot 158 and gap 141 away from housing 140 until body 167 abuts housing 140.

The force required to open or close the drawer can be adjusted by adjusting the compression of the helical spring. The compression of spring 146 increases as threaded section 152 is advanced. As the compression of spring 146 increases, the force required to move protrusion 166 through slot 158 and gap 141 toward housing 140 also increases. Adjusting the position of threaded section 152 relative to piston 142 thus adjusts the force necessary to move protrusion 166 through slot 158. Rotating screw 144 in a clockwise direction shortens the distance between threaded section 152 and piston 142 thus compressing spring 146 and thus requiring a greater force to open or close the drawer. Rotating screw 144 in a counter-clockwise direction lengthens the distance between threaded section 152 and piston 142 decompressing spring 146 and thus reducing the force necessary to open or close the drawer.

During an opening sequence, a sufficient force is applied in the opening direction shown by arrow 220. The opening force must overcome the frictional force between bumper 110 and extensions 127 and 129. Simultaneously, raised indention 114 forces protrusion 166, against the bias of spring 146, through slot 158. Once protrusion 166 clears raised indention 114, spring 146 forces protrusion 166 through slot 158 and gap 141 until body 167 abuts housing 140 and the drawer is free to slide to its fully opened position unencumbered.

In a "closed" position as shown in FIG. 7C, drawer retainer mechanism 108 works cooperatively with bumper 110 and extensions 127 and 129 to prevent the drawer from inadvertently opening without a sufficient force applied in the opening direction, as shown by direction arrow 220. The combination of drawer retainer mechanism 108 and bumper 110 and extensions 127 and 129 further prevents the drawer from rebounding from the closed position.

Figure 8:
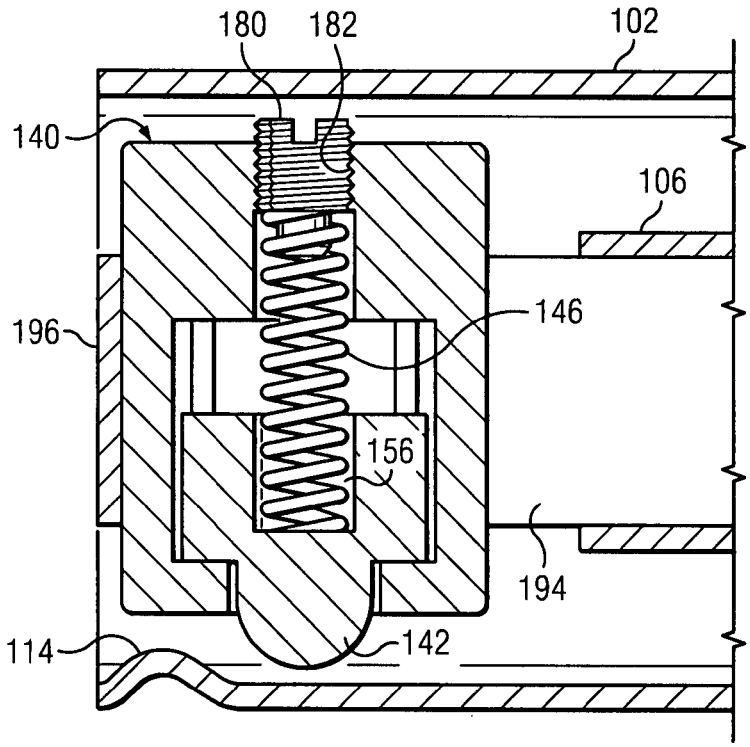
FIG. 8 is a partial cross section view in a closed position of an alternate preferred embodiment of the drawer slide assembly.

In an alternate preferred embodiment shown in FIG. 8, housing 140 is mounted on tab 194 and constrained on one side by flange 196. Tab 194 extends from drawer slide 106. Tab 194 is integrally formed with drawer slide 106. Flange 196 is integrally formed with tab 194. In another alternative embodiment, tab 196 is not present. Housing 140 is mounted on tab 194 using common attachment hardware such as welding, rivets, or machine screws or with a suitable epoxy adhesive. Plug 180 is threaded for engagement with threaded hole 182 and upon rotation advances or retreats through threaded hole 182. Spring 146 is constrained by threaded hole 182 and hole 156 in piston 142. Spring 146 is adjacent plug 180 and bottom 157. Spring 146 biases piston 142 against raised indention 114. Adjusting the position of plug 180 relative to piston 142 adjusts the compression of spring 146 and thus adjusts the bias of piston 142 against raised indention 114.

Figure 9:
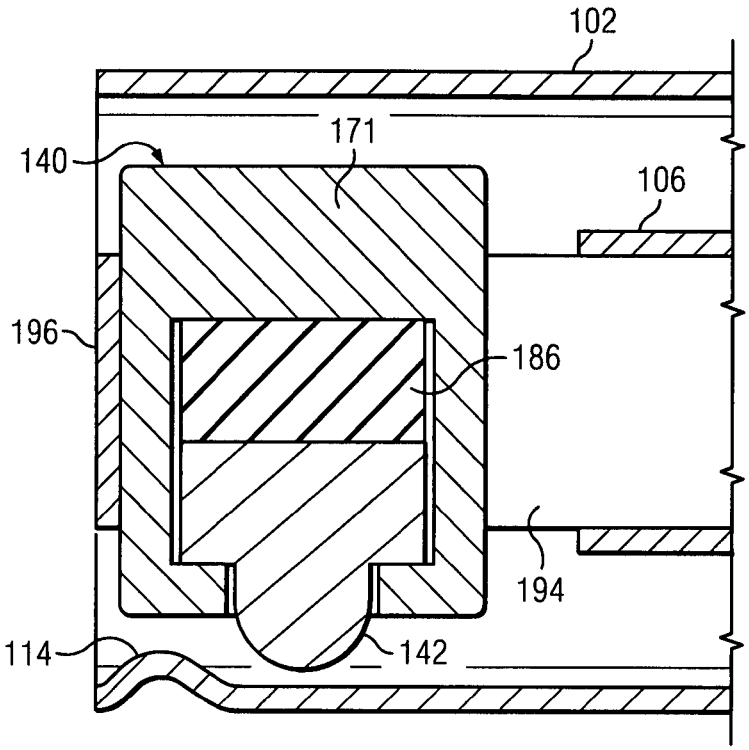
FIG. 9 is a partial cross section view in a closed position of an alternate preferred embodiment of the drawer slide assembly.

In an alternate preferred embodiment shown in FIG. 9, housing 140 is mounted on tab 194 and constrained by flange 196. Flexible member 186 is wedged between center support 171 of housing 140 and piston 142. Flexible member 186 is constructed of rubber or closed shell plastic shock absorbing foam or any resilient substance having compressive shock absorbing and rebounding features. Flexible member 186 biases piston 142 against raised indention 114.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A drawer retainer mechanism attached to a drawer slide assembly comprising:

a frame having a plurality of flanges;

a threaded hole through a first flange of the plurality of flanges;

a housing having an interior formed by a chamber;

the housing connected to the frame;

a post having a threaded section engaged with the threaded hole;

the housing further comprising a first hole leading to the chamber through which the post extends;

the housing further comprising an outlet having a stepped recess wherein the outlet is axially aligned with the first hole;

the housing further comprising a first guide ridge and a second guide ridge;

a piston seated in the chamber;

the piston having a body section and a rounded protrusion extending through the outlet and between a second flange of the plurality of flanges and a third flange of the plurality of flanges;

the piston further comprises a second hole in the body section, a first channel and a second channel flanking the second hole, where axes of the first channel and the second channel are generally parallel with an axis of the second hole, and wherein the first channel engages the first guide ridge and the second channel engages the second guide ridge, and wherein the post extends into the second hole; and, a helical spring surrounding the post and biasing the threaded section and the piston.

2. The drawer retainer mechanism of claim 1 wherein the threaded hole, the first hole, the post, and the second hole are axially aligned.

3. The drawer retainer mechanism of claim 1 wherein the housing further comprises the first guide ridge and the second guide ridge slidingly engaged with the first channel and the second channel.

4. A full extension ball bearing drawer slide assembly apparatus for mounting a drawer piece to a cabinet piece, the drawer slide assembly apparatus comprising:

a cabinet slide mounted to the cabinet piece where the cabinet slide further comprises a race having a raised indention and a tab supporting a bumper;

a middle slide slidingly engaged with the cabinet slide;

a drawer slide slidingly engaged with the middle slide and mounted to the drawer piece;

the drawer slide further connected to a retainer mechanism and having a first extension and a second extension separated by a cavity;

the retainer mechanism further comprising:

a frame for connection to the drawer slide;

a housing connected to the frame; and a piston slidingly seated in the housing;

a post passing through a first hole in the housing and having a threaded section engaged with a threaded hole in the frame for adjusting the position of the post relative to the piston;

a spring surrounding the post and biasing the threaded section and the piston, where the spring is constrained by the post, the housing, and the piston; and wherein the retainer mechanism has a closed position where the raised indention engages the piston while the bumper is simultaneously wedged in the cavity between the first extension and the second extension; and wherein the retainer mechanism has an opened position where the piston is not engaged with the raised indention and the bumper is not wedged in the cavity between the first extension and the second extension.

5. The drawer slide assembly of claim 4 wherein the piston further comprises:

a body section having a second hole and integrally formed with a protrusion extending through an outlet in the housing to engage the raised indention.

6. The drawer slide assembly of claim 5 where the post, the first hole, the threaded hole, and the second hole are axially aligned.

* * * * *

UNITED STATES PATENT AND TRADEMARK OFFICE

CERTIFICATE OF CORRECTION

PATENT NO. : 8,876,230 B2
APPLICATION NO. : 13/200571
DATED : November 4, 2014
INVENTOR(S) : Mark Jeffrey Lowe and Grant Nuckolls It is certified that error appears in the above-identified patent and that said Letters Patent is hereby corrected as shown below:

In the Specification,
In Column 4, Line 37 "detent" should be changed to --piston--

In the Claims,
In Column 6, Line 50, Claim 1 "where axes" should read --where the axes--

Signed and Sealed this
Twenty-fourth Day of March, 2015

Michelle K. Lee

Michelle K. Lee
*Director of the United States Patent and Trademark Office*